US009452311B1

(12) United States Patent
Kaczmarek

(10) Patent No.: US 9,452,311 B1
(45) Date of Patent: Sep. 27, 2016

(54) VERSATILE EXERCISE APPARATUS

(71) Applicant: Daniel Kaczmarek, Dallas, TX (US)

(72) Inventor: Daniel Kaczmarek, Dallas, TX (US)

( * ) Notice: Subject to any disclaimer, the term of this patent is extended or adjusted under 35 U.S.C. 154(b) by 0 days.

(21) Appl. No.: 14/446,058

(22) Filed: Jul. 29, 2014

Related U.S. Application Data

(60) Provisional application No. 61/859,842, filed on Jul. 30, 2013.

(51) Int. Cl.
*A63B 21/02* (2006.01)
*A63B 21/055* (2006.01)
*A63B 21/00* (2006.01)

(52) U.S. Cl.
CPC ..... *A63B 21/0552* (2013.01); *A63B 21/143* (2013.01); *A63B 21/1415* (2013.01); *A63B 21/1438* (2013.01)

(58) Field of Classification Search
CPC ..... A63B 1/00; A63B 3/00; A63B 7/00; A63B 7/02; A63B 7/04; A63B 7/045; A63B 7/08; A63B 7/085; A63B 9/00; A63B 2009/004; A63B 2009/006; A63B 19/00; A63B 19/02; A63B 19/04; A63B 21/00061; A63B 21/00065; A63B 21/00069; A63B 21/00072; A63B 21/00076; A63B 21/00094; A63B 21/00098; A63B 21/00101; A63B 21/00109; A63B 21/00116; A63B 21/0012; A63B 21/00123; A63B 21/00127; A63B 21/0013; A63B 21/00134; A63B 21/00138; A63B 21/00149; A63B 21/00152; A63B 21/00156; A63B 21/0016; A63B 21/00163; A63B 21/00167; A63B 21/0017; A63B 21/00174; A63B 21/00178; A63B 21/00181;

(Continued)

(56) References Cited

U.S. PATENT DOCUMENTS 3,083,037 A * 3/1963 Gordon ..... A63B 19/04 280/206
4,302,006 A * 11/1981 Johnson ..... B62K 1/00 280/206

(Continued)

*Primary Examiner* — Oren Ginsberg
*Assistant Examiner* — Gary D Urbiel Goldner
(74) *Attorney, Agent, or Firm* — Kenneth L Tolar

(57) ABSTRACT

An exercise apparatus includes a base frame formed of a pair of spaced, circular inner rails, each having an angularly-adjustable, semicircular side rail attached thereto. The upper portion of the base frame includes a pair of handlebars for performing certain pulling exercises. An elastomeric resistance band is securable to any one of a plurality of spaced rings positioned on the entire inner circumference of the inner rails and the side rails. An opposing end of the resistance band is secured to a wearable accessory to allow a user to perform virtually any desired exercise at various angles.

17 Claims, 4 Drawing Sheets

(58) Field of Classification Search
CPC ..... A63B 21/00185; A63B 21/02; A63B 21/04; A63B 21/0407; A63B 21/0414; A63B 21/0421; A63B 21/0428; A63B 21/0435; A63B 21/0442; A63B 21/045; A63B 21/0455; A63B 21/055; A63B 21/0552; A63B 21/0555; A63B 21/0557; A63B 21/065; A63B 21/068; A63B 21/08; A63B 21/14; A63B 21/1403; A63B 21/1415; A63B 21/1419; A63B 21/1423; A63B 21/1426; A63B 21/143; A63B 21/1434; A63B 21/1438; A63B 21/1442; A63B 21/1446; A63B 21/1449; A63B 21/1465; A63B 21/1469; A63B 21/1476; A63B 21/1484; A63B 21/1488; A63B 21/1492; A63B 21/1496; A63B 21/16; A63B 2023/003; A63B 2023/006; A63B 23/0211; A63B 23/0216; A63B 23/0222; A63B 23/0227; A63B 23/035; A63B 23/03516; A63B 23/03533; A63B 23/03541; A63B 23/0355; A63B 23/03558; A63B 23/03566; A63B 23/03575; A63B 23/03583; A63B 23/03591; A63B 23/04; A63B 23/0405; A63B 23/0482; A63B 23/0488; A63B 23/0494; A63B 23/08; A63B 23/12; A63B 23/1209; A63B 23/1218; A63B 23/1245; A63B 23/1281; A63B 69/0057; A63B 69/0059; A63B 69/0064; A63B 2069/0062; A63B 2208/0204; A63B 2208/0209; A63B 2208/0214; A63B 2208/0219; A63B 2208/0223; A63B 2208/0228; A63B 2208/0233; A63B 2208/0238; A63B 2208/0242; A63B 2208/0247; A63B 2208/0252; A63B 2208/0257; A63B 2208/0266; A63B 2208/0285; A63B 2208/029; A63B 2208/0295; A63B 2225/09; A63B 2225/093; A63B 2225/10; A63B 2225/102; A63B 2225/105; A63B 2225/107
USPC ..... 482/907
See application file for complete search history.

(56) References Cited

U.S. PATENT DOCUMENTS

| | | | | | |
|---|---|---|---|---|---|
| 5,046,721 | A * | 9/1991 | Altare | A63B 19/04 | 428/47 |
| 5,792,031 | A * | 8/1998 | Alton | A63B 69/0059 | 482/78 |
| 6,102,836 | A * | 8/2000 | Person | A63B 21/0615 | 482/102 |
| 6,685,600 | B1 * | 2/2004 | Ullman | A63B 21/062 | 482/100 |
| 7,887,471 | B2 * | 2/2011 | McSorley | A63B 21/0552 | 482/136 |
| 7,998,041 | B1 * | 8/2011 | Johnson | A63B 21/0552 | 482/124 |
| 2002/0187880 | A1 * | 12/2002 | Johnson | A63B 19/02 | 482/78 |
| 2003/0166441 | A1 * | 9/2003 | Kerry | A63B 69/0057 | 482/140 |
| 2004/0033869 | A1 * | 2/2004 | Carlson | A63B 21/023 | 482/121 |
| 2004/0214696 | A1 * | 10/2004 | Kerry | A63B 69/0057 | 482/140 |
| 2004/0242389 | A1 * | 12/2004 | Kerry | A63B 69/0057 | 482/140 |
| 2006/0240956 | A1 * | 10/2006 | Piane | A63B 21/055 | 482/94 |
| 2007/0083975 | A1 * | 4/2007 | Senegal | A63B 21/0552 | 2/102 |
| 2008/0032807 | A1 * | 2/2008 | King et al. | A63B 9/00 | 472/136 |
| 2009/0011909 | A1 * | 1/2009 | Glisan | A63B 21/0552 | 482/129 |
| 2010/0130330 | A1 * | 5/2010 | McSorley | A63B 23/16 | 482/48 |
| 2010/0130336 | A1 * | 5/2010 | McSorley | A63B 21/0552 | 482/110 |
| 2010/0190617 | A1 * | 7/2010 | Gautier | A63B 21/005 | 482/94 |
| 2011/0251033 | A1 * | 10/2011 | Blancher | A63B 21/0442 | 482/123 |
| 2012/0202656 | A1 * | 8/2012 | Dorsay | A63B 21/156 | 482/121 |
| 2013/0303344 | A1 * | 11/2013 | Rasnake | A63B 21/02 | 482/124 |

* cited by examiner

VERSATILE EXERCISE APPARATUS

CROSS REFERENCE TO RELATED APPLICATIONS

This application is entitled to the benefit of provisional patent application No. 61/859,842 filed on Jul. 30, 2013, the specification of which is incorporated herein by reference.

BACKGROUND OF THE INVENTION

The present invention relates to an apparatus that allows a user to perform virtually an unlimited number of exercises with elastomeric resistance bands.

DESCRIPTION OF THE PRIOR ART

In order to engage in a comprehensive training regimen, an exerciser must typically visit a gym or health club having specialized equipment that targets certain muscles. Usually, each exercise is performed on a different, complex machine having weight stacks that are lifted with rods or cables. To work the entire body, the exerciser must use numerous machines, each of which requires a seat and weight adjustment. When finished, the exerciser must wipe the seat and repeat the task at another machine, which is tedious and laborious. Furthermore, because each machine only targets a specific muscle group, the exerciser must have access to a significant number of machines in order to work the entire body.

Accordingly, there is currently a need for an exercise device that is more versatile than a conventional weight machine. The present invention addresses this need by providing an apparatus that allows an exerciser to perform virtually an unlimited number of exercises using elastomeric resistance bands to target any desired muscle group. Specifically, the device includes a pair of substantially upright, circular rails, each having a semicircular side rail pivotally attached thereto. Each of the rails has a plurality of spaced rings on an inner circumference to which elastomeric bands can be secured to perform a myriad of resistance exercises at various angles. For example, the semi-circular rails with the circumferential rings allow a user to perform numerous suspension-type core exercises while allowing the angle of the limbs relative to the body to be easily varied in both horizontal and vertical planes. Similarly, the upright rails with circumferentially disposed rings allow a user to perform vertical exercises from a myriad of angles, such as hanging leg raises, or arm or leg pulls.

SUMMARY OF THE INVENTION

The present invention relates to an exercise apparatus comprising a base frame formed of a pair of spaced, downwardly-diverging, circular inner rails, each having an angularly adjustable, semicircular side rail attached thereto. The upper portion of each inner rail includes a handlebar for performing certain pulling or hanging exercises. An elastomeric resistance band is securable to any of a plurality of spaced rings positioned on the entire inner circumference of the inner rails and the side rails. A wearable accessory is attachable to a distal end of the resistance band to allow a user to perform virtually any desired exercise at various angles.

It is therefore an object of the present invention to provide an apparatus that allows a user to perform an unlimited number of exercises.

It is another object of the present invention to provide an exercise apparatus that eliminates the need for numerous, expensive machines in order to target multiple muscle groups.

Other objects, features, and advantages of the present invention will become readily apparent from the following detailed description of the preferred embodiment when considered with the attached drawings and the appended claims.

DESCRIPTION OF THE PREFERRED EMBODIMENT

Figure 1:
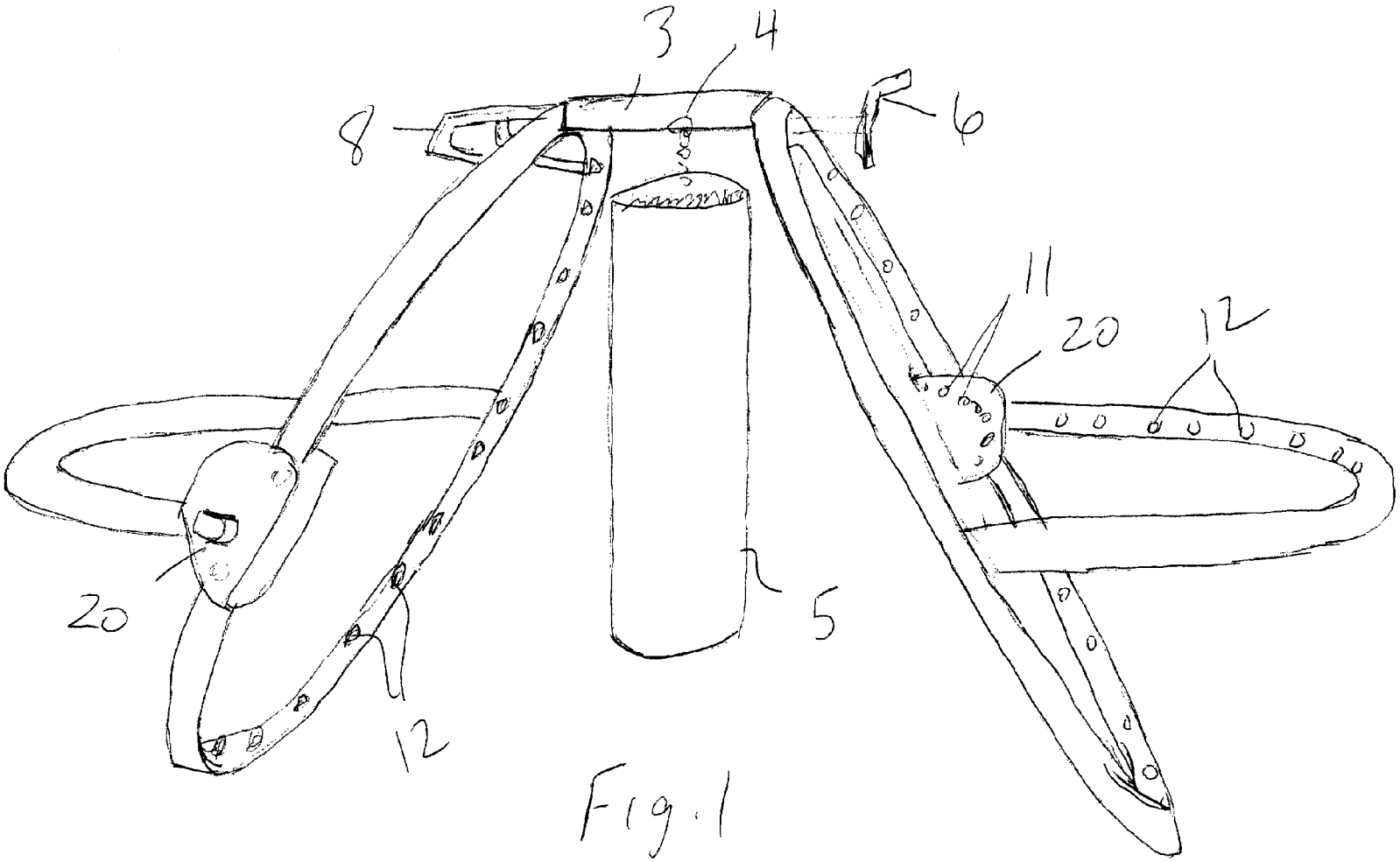
FIG. 1 is a perspective view of the exercise apparatus according to the present invention.
Figure 2:
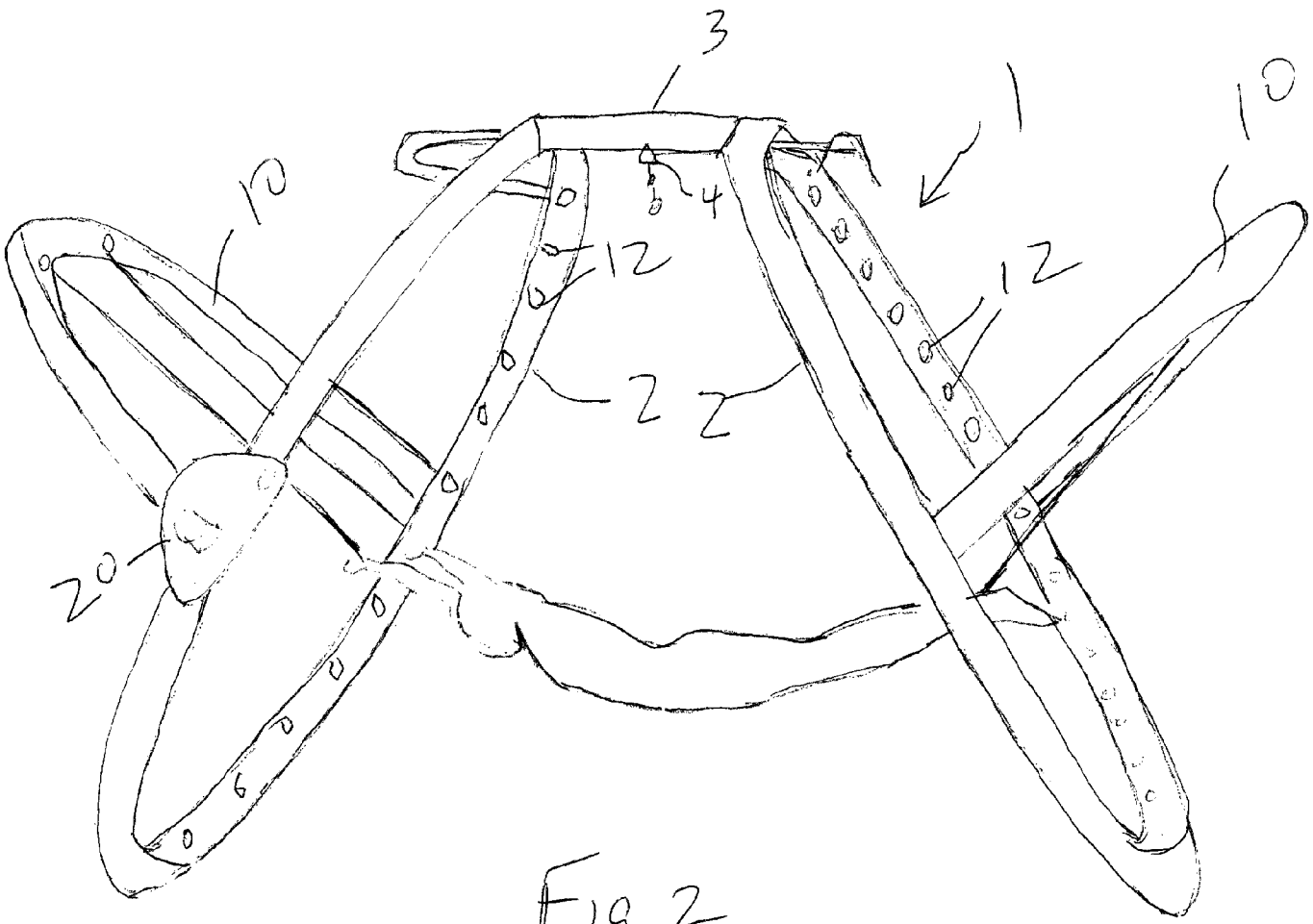
FIG. 2 is a perspective view of the apparatus being used by an exerciser.
Figure 3:
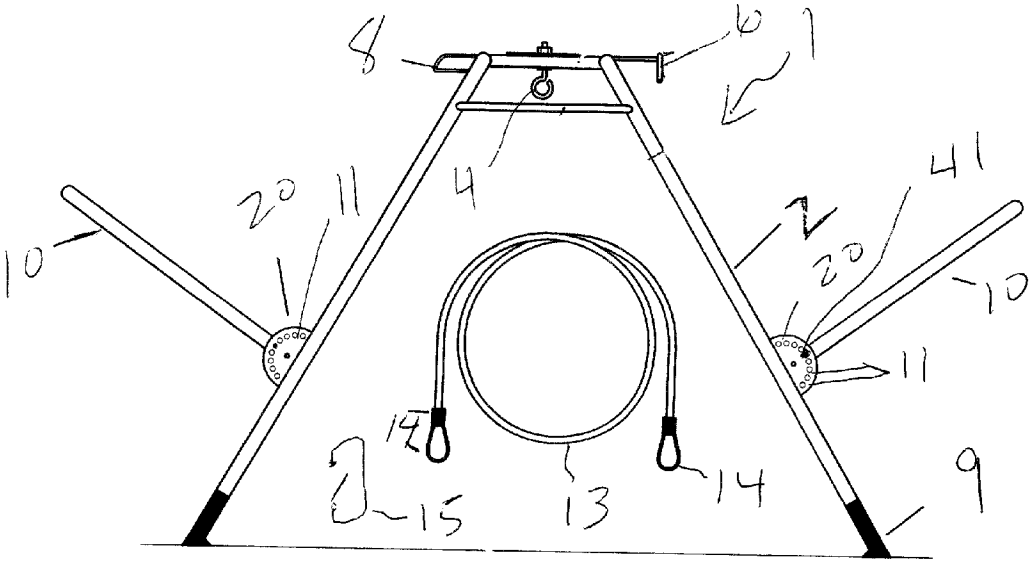
FIG. 3 is a front, plan view of the apparatus.
Figure 5:
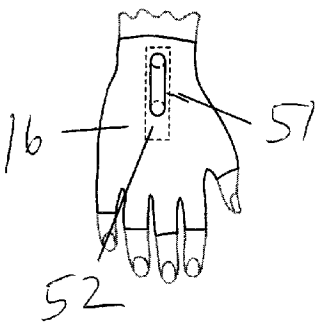
FIG. 5 depicts the glove.
Figure 4:
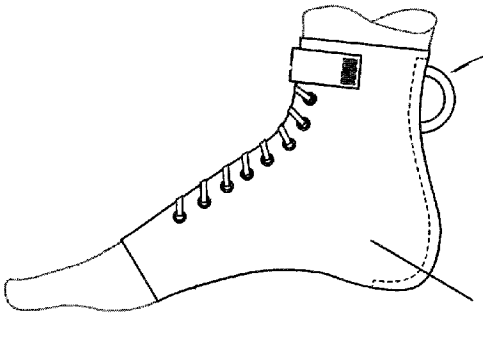
FIG. 4 depicts the boot.
Figure 7:
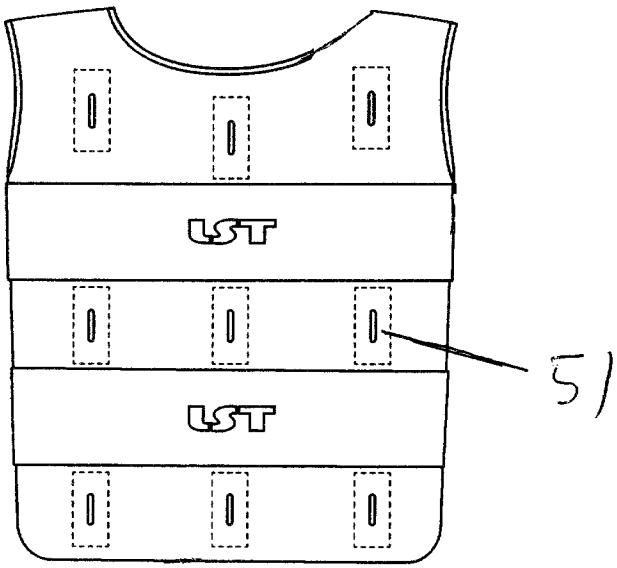
FIG. 7 is a rear view of the vest.
Figure 6:
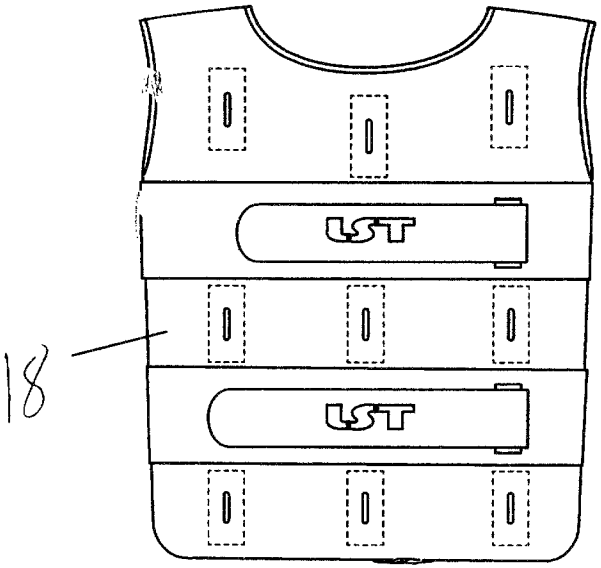
FIG. 6 is a front view of the vest.

The present invention relates to an exercise apparatus comprising a base frame 1 formed of a pair of spaced, downwardly diverging inner rails 2 that are each formed of a circular tube. The upper portions of the inner rails are joined with a pair of cross beams having a cover plate 3 superimposed thereon. An eye bolt 4 depends from the lower surface of the cover plate for suspending a heavy punching bag 5 or similar exercise equipment.

Attached to the upper segment of one of the inner rails is a first, substantially linear handlebar 6 having a pair of opposing, downwardly-angled handgrips 7. The upper segment of the other inner rail includes a pair of D-shaped handlebars 8 for performing certain pulling exercises. A footpad 9 on the lower segment of each inner rail stabilizes the frame on an underlying surface.

Pivotally attached to each inner rail is a semi-circular side rail 10 having a pair of distal ends that are each seated within an adjustment plate 20. Each distal end has a transverse bore that aligns with any one of a plurality of peripheral apertures 11 on the adjustment plate. A spring-biased locking pin 41 releasably fits within an aligned aperture and bore to fix either side rail at a desired angle. The entire inner circumference of both the inner rails and the side rails includes a plurality of spaced rings 12 to which any one of a number of elastomeric resistance bands 13 is secured to allow a user to perform virtually any desired exercise, at any desired angle.

The elasticity of each resistance band is varied to correspond to a given weight unit, allowing a user to select the intensity of an exercise, as desired. Accordingly, each resistance band is color-coded and labeled to conspicuously identify the given weight unit. The resistance bands include a loop 14 at each of two opposing ends. One of the loops is secured to a releasable clamp 15 that connects the band to the frame while the opposing loop is secured to an accessory worn by the exerciser.

The wearable accessory includes at least a glove 16, a boot 17 and a vest 18, each having one or more rings 51 thereon for coupling with the desired resistance band. The boot and glove each include laces that are covered with a releasable flap 52 to prevent interference with the exerciser's movements. An opposing end of the band is secured to any one of the rings on the inner rails or side rails to allow the user to perform virtually any exercise that targets a desired muscle group. In addition, the circular rails allow a user to vary the angle of the limbs relative to the body in the x, y and z planes to assure a more comprehensive regimen that targets all muscle groups.

The above-described device is not limited to the exact details of construction and enumeration of parts provided herein. Furthermore, the size, shape and materials of construction of the various components can be varied.

Although there has been shown and described the preferred embodiment of the present invention, it will be readily apparent to those skilled in the art that modifications may be made thereto which do not exceed the scope of the appended claims. Therefore, the scope of the invention is only to be limited by the following claims.

What is claimed is:

1. An exercise apparatus comprising:

a base frame formed of a pair of substantially upright, circular inner rails, each of said inner rails having a downwardly diverging lower segment and an inner circumference with a plurality of rings positioned along an entire length thereof, one of said inner rails including an upper segment having a handlebar thereon for performing hanging exercises, and another of said inner rails including an upper segment having a pair of D-shaped handlebars thereon for performing pulling exercises;

a pair of cross beams joining the upper segment of one of said inner rails with the upper segment of another of said inner rails, said cross beams having a cover plate superimposed thereon, said cover plate having a fastener for suspending an exercise apparatus;

a semicircular side rail pivotally attached to each of said inner rails, said side rail having an inner circumference with a plurality of rings positioned along an entire length thereof;

an elastomeric resistance band securable to any of said rings on said semicircular side rail and said circular inner rails to allow a user to perform a myriad of exercises at various angles.

2. The exercise apparatus according to claim 1 further comprising a means for locking said side rail at a desired angle.

3. The exercise apparatus according to claim 1 further comprising a wearable accessory attachable to said resistance band.

4. The exercise apparatus according to claim 3 wherein said wearable accessory is selected from the group consisting of a glove, a boot and a vest.

5. The exercise apparatus according to claim 1 further comprising a footpad on the lower segment of each of said inner rails that stabilizes the frame on an underlying surface.

6. The exercise apparatus according to claim 1 wherein said resistance band has a select elasticity that corresponds to a given weight unit and is color-coded and labeled to conspicuously identify the given weight unit.

7. The exercise apparatus according to claim 1 wherein said semi-circular side rail includes a pair of distal ends, each of said distal ends having a transverse bore, said pair of distal ends each seated within an adjustment plate mounted on one of said inner rails, said adjustment plate having a plurality of peripheral apertures thereon, said bore aligned with a select one of said apertures to receive a locking pin to fix said side rail at a desired angle relative to said one of said inner rails.

8. The exercise apparatus according to claim 1 wherein said side rail extends outwardly from each of said inner rails and pivots about a horizontal axis that is tangential to each of said inner rails.

9. An exercise apparatus comprising:

a base frame formed of a pair of substantially upright, circular inner rails, each of said inner rails having a downwardly diverging lower segments and an inner circumference with a plurality of rings positioned along an entire length thereof;

a semicircular side rail pivotally attached to each of said inner rails, said side rail extending outwardly from each of said inner rails and pivoting about a horizontal axis that is tangential to each of said inner rails, said side rail having an inner circumference with a plurality of rings positioned along an entire length thereof;

an elastomeric resistance band securable to any of said rings on said semicircular side rail and said circular inner rails to allow a user to perform a myriad of exercises at various angles.

10. The exercise apparatus according to claim 9 wherein one of said inner rails includes an upper segment having a handlebar thereon for performing hanging exercises.

11. The exercise apparatus according to claim 10 wherein another of said inner rails includes an upper segment having a pair of D-shaped handlebars thereon for performing pulling exercises.

12. The exercise apparatus according to claim 9 further comprising a pair of cross beams joining the upper segment of one of said inner rails with the upper segment of another of said inner rails, said cross beams having a cover plate superimposed thereon, said cover plate having a fastener for suspending an exercise apparatus.

13. The exercise apparatus according to claim 9 further comprising a means for locking said side rail at a desired angle.

14. The exercise apparatus according to claim 9 further comprising a wearable accessory attachable to said resistance band.

15. The exercise apparatus according to claim 14 wherein said wearable accessory is selected from the group consisting of a glove, a boot and a vest.

16. The exercise apparatus according to claim 9 further comprising a footpad on the lower segment of each of said inner rails that stabilizes the frame on an underlying surface.

17. The exercise apparatus according to claim 9 wherein said resistance band has a select elasticity that corresponds to a given weight unit and is color-coded and labeled to conspicuously identify the given weight unit.

* * * * *